US005372858A

United States Patent [19]

Saylor, III

[11] Patent Number: 5,372,858

[45] Date of Patent: Dec. 13, 1994

[54] METHOD AND APPARATUS FOR APPLYING A PLASTIC COATING TO WOVEN YARN TUBING

[75] Inventor: Frank D. Saylor, III, Asheville, N.C.

[73] Assignee: Loom Products, Inc., Asheville, N.C.

[21] Appl. No.: 157,967

[22] Filed: Nov. 24, 1993

[51] Int. Cl.[5] ..... B05D 1/18

[52] U.S. Cl. ..... 427/512; 118/65; 118/67; 118/68; 118/405; 118/419; 118/423; 427/322; 427/385.5; 427/412; 427/434.7; 427/513; 427/521; 427/559

[58] Field of Search ..... 118/65, 67, 68, 405, 118/419, 423; 427/512, 322, 385.5, 412, 434.7, 513, 521, 559

[56] References Cited

U.S. PATENT DOCUMENTS

| | | | |
|---|---|---|---|
| 3,765,979 | 10/1973 | Thomas | 285/21 |
| 3,847,694 | 11/1974 | Stewing | 285/21 |
| 3,949,153 | 4/1976 | Pirooz et al. | 174/15 C |
| 3,958,074 | 5/1976 | Pirooz et al. | 174/156 |
| 4,215,234 | 7/1980 | Hayashi et al. | 174/15 C |
| 4,698,488 | 10/1987 | Kishimoto | 219/549 |
| 4,857,012 | 8/1989 | Yard | 439/471 |
| 5,147,714 | 9/1992 | Ellison et al. | 428/254 |

*Primary Examiner*—Bernard Pianalto
*Attorney, Agent, or Firm*—Carter & Schnedler

[57] ABSTRACT

Methods and apparatus for applying a plastic coating to woven yarn tubing to provide conduit for protecting wiring harnesses and the like. The resulting plastic coating layer is very thin so as to generally follow the contours of the woven yarn tubing, without filling in the valleys, thus minimizing the amount of plastic used. Woven yarn tubing is waterproofed by impregnating with latex sealant, and is continuously pulled by a take-up mechanism along a horizontal axis through a heated die and two treating stations in tandem. Each of the treating stations includes a coating pot containing liquid plastisol material and having a resilient circular exit die through which the tubing exits the coating pot to form a layer of liquid plastisol, and an infrared curing oven which heats the plastisol-coated tubing sufficiently to cure the plastisol layer. The tubing, while coated with uncured plastisol material, is not contacted by any element which would tend to deform the tubing from a circular cross section.

22 Claims, 2 Drawing Sheets

METHOD AND APPARATUS FOR APPLYING A PLASTIC COATING TO WOVEN YARN TUBING

BACKGROUND OF THE INVENTION

The present invention relates generally to woven yarn tubing or conduit used for protecting wiring harnesses and the like and, more particularly, to the application of a protective plastic coating to such tubing.

Tubing or conduit for enclosing and protecting wiring harnesses used, for example, in automobiles and electric appliances, is conventionally made by employing a circular loom to produce a woven yarn tubing base material. The woven yarn tubing is made in various sizes, normally ranging from ⅛ inch to one inch in diameter. While a variety of materials may be employed, commonly twisted paper is wound generally in a helix to form the woof yarn, and a cotton/polyester fiber blend forms the warp yarn, running generally lengthwise. The twisted paper woof yarn typically ranges in diameter from 0.030 inch to 0.070 inch, depending on the diameter of the tubing being made, while the cotton/polyester fiber warp yarn typically ranges from #14 cotton count to #8/3 cotton count, again depending on the diameter of the tubing being made. These yarn sizes result in woven yarn tubing with corresponding surface contours.

The woven yarn tubing base material is then waterproofed by impregnating the fibers with a latex sealant. Conventionally, an outer protective layer of asphalt is then formed. In particular, the asphalt is applied as a hot liquid which, upon cooling, immediately solidifies. Thereafter, the asphalt-coated tubing is cut to length and, in some cases, slit lengthwise.

The traditional asphalt-coated conduit, while relatively low in cost, and generally suitable, nevertheless leaves room for improvement.

Thus, alternative coating materials have been employed, such as plastic materials. Plastic as a coating material has a number of advantages compared to asphalt. Plastic is more resistant to oil. Plastic has better resistance to temperature and abrasion. Plastic-coated conduit is easier to cut and slit cleanly than asphalt-coated conduit. In addition, plastic affords the possibility of having a variety of colors, other than black.

Heretofore, plastic coatings have been applied to latex-impregnated woven yarn tubing by a process which involves pulling the tubing upwardly through a coating pot containing a liquid plastisol material and having a resilient circular exit die through which the tubing exits the coating pot vertically, forming a layer of liquid plastisol on the tubing. The plastisol layer is then cured by pulling the tubing further upwardly through a generally cylindrical gas-fired curing oven, having an annular burner near the bottom.

While plastic coatings to woven fabric tubing have previously been applied by the process summarized just above, due to a number of disadvantages such is typically employed only in special circumstances, for example where a particular color is desired.

One disadvantage of the prior process is its relatively high cost, perhaps twice as much as an asphalt coating process. One reason for the higher cost is that the coating process proceeds relatively slowly, typically in the order of less than two feet per minute, in sharp contrast to asphalt coating processes, which can proceed at rates of up to 325 feet per minute. Asphalt does not need to be cured; it solidifies to its final form simply upon cooling.

Another reason for the relatively high cost of the prior plastic coating process is the cost of the plastisol material, which is significantly higher than the cost of asphalt coating material.

Another disadvantage of the prior process is that the resultant tubing is not uniformly circular in cross section. While the plastisol is uncured or in the process of curing, it is highly susceptible to deformation, which can become a permanent deformation in the finished product. Moreover, more plastisol coating material tends to be used when the tubing is not circular in cross section.

SUMMARY OF THE INVENTION

Accordingly, it is an object of the invention to provide methods and apparatus for making a cost-effective and improved alternative to asphalt-coated woven yarn tubing.

It is another object of the invention to provide methods and apparatus for applying a plastic coating to woven yarn tubing in a manner which is cost competitive with the coating of woven yarn tubing with asphalt.

It is a related object of the invention to apply plastic coating to woven yarn tubing in a continuous process at a relatively high rate.

It is another related object of the invention to minimize the use of plastisol material, while still providing an effective protective coating.

In very brief overview, a significant aspect of the invention is the application of a very thin coat of liquid plastisol material which follows the contours of the woven yarn tubing. Otherwise, the filling in of "valleys" and the resultant leveling off of peaks and valleys tends to use too much of the expensive plastisol material. A related aspect of the invention is maintaining a circular cross section while the tubing is being coated. If the tubing gets out of round, the resultant "flat" side or sides tend to take on excess plastic material. An additional benefit of the thin coat of plastisol material is there is less material for curing heat to penetrate, which can facilitate rapid curing and contribute to process speed.

A more particular aspect of the invention is the provision of a method for applying a plastic coating to woven yarn tubing. An initial step of the method is providing a length of woven yarn tubing having a contoured surface, preferably tubing which has been impregnated with a latex sealant for waterproofing. A subsequent step in the method is continuously pulling the tubing through a coating pot containing a liquid plastisol material and having a resilient circular exit die through which the tubing exits the coating pot to form a layer of liquid plastisol on the tubing sufficiently thin so as to follow the surface contours, and then through an infrared curing oven including an infrared heating element which heats the plastisol-coated tubing sufficiently to cure the plastisol layer, all without contacting the tubing while coated with uncured plastisol with any element which would tend to deform the tubing from a circular cross section. Preferably, the tubing is additionally pulled, as part of a continuous process, through a second coating pot like the first, and through a second infrared oven, again without contacting the tubing while coated with uncured plastisol with any element which would tend to deform the tubing from a circular cross section.

Preferably, immediately prior to the initial coating pot, the tubing is pulled through a heated circular die. This serves the dual purposes of rounding up the tubing and inducing any loose fibers ("hairs") to lie against the surfaces of the tubing, resulting in a more uniform final product. Moreover, round tubing requires less plastic material.

The tubing is pulled horizontally in substantially a straight line as the tubing moves along a movement axis, through the heated circular die, through the initial coating pot, through the initial infrared curing oven, through the second coating pot and through the second infrared curing oven, with nothing touching the tubing other than the heated circular die and resilient circular entrance and exit dies associated with the coating pots. The only deviation from a straightline is as a result of sagging under the force of gravity.

Another important aspect of the inventive process is the use of the infrared curing ovens, in contrast to previously-employed gas-fired vertical curing ovens. Such allows a greater process speed to be achieved. In particular, infrared heating elements heat the product quickly and directly, and heating is not dependent upon convective heat transfer. In addition, the intensity of the infrared heating elements is easily controlled, facilitating adjustment to a point where optimum results are achieved.

In addition, process speed is enhanced, while still ultimately applying a sufficient thickness of plastic material, by employing two stations in series, each of the two stations including a coating pot and an infrared curing oven.

Uniformity of the product is enhanced and plastisol usage is minimized, as mentioned above, by not contacting the tubing while coated with uncured plastisol material with any element which would tend to deform the tubing from a circular cross section, such as by running the tubing over a pulley either for support or for changing direction.

In accordance with another more particular aspect of the invention, there is provided corresponding apparatus for applying a plastic coating to woven yarn tubing having a contoured surface and continuously moving along a movement axis and, in particular, for applying a plastic coating to woven yarn tubing which has been impregnated with a latex sealant for waterproofing. The apparatus includes at least a first coating pot containing a liquid plastisol material and located on the movement axis. The first coating pot includes a resilient circular entrance die and a resilient circular exit die positioned in alignment with the movement axis such that the woven yarn tubing passes through the entrance die to the interior of the coating pot and then through the exit die. The dies and the tubing thus cooperate to prevent flow of the liquid plastisol material out of the coating pot, while allowing a layer of liquid plastisol material sufficiently thin so as to follow the surface contours to remain on the tubing as the tubing passes through the exit die.

Also located on the movement axis, downstream of the coating pot, is an infrared curing oven. The infrared curing oven has an entrance aperture in alignment with the movement axis through which plastisol-coated tubing enters the curing oven and an exit aperture also in alignment with the movement axis through which the tubing exits the curing oven. The curing oven includes at least one infrared heating element operable to heat the plastisol-coated tubing sufficiently to cure the plastisol layer.

To minimize the amount of plastisol applied, the coating pot exit die is made of relatively stiff rubber material, and the exit die is installed "backwards". Thus, the exit die has a tapered aperture such that the aperture opening is relatively smaller in diameter on one side (defining a bevel of less than 90° between the one side and the aperture), and is relatively larger in diameter on the other side (defining a bevel of greater than 90° between the other side and the aperture). A "normal" orientation of a die is such that tubing enters the relatively larger opening side and leaves through the relatively smaller opening side. In accordance with the invention, the exit die is oriented such that the one side of the exit die with the relatively smaller aperture opening (with the bevel of less than 90° ) faces the entrance die, i.e., faces upstream.

Preferably, there is a second coating pot downstream of the first infrared curing oven, also located on the movement axis and constructed substantially the same as the first curing pot. Correspondingly, downstream of the second coating pot is a second infrared curing oven, also on the movement axis, and constructed substantially the same as the first infrared curing oven.

To pull the woven yarn tubing through the various dies, a take-up mechanism is located on the movement axis downstream of the last infrared curing oven. The take-up mechanism thus pulls the tubing through the coating pots and through the infrared curing ovens.

Preferably, to provide conformity of the tubing to a circular cross section and to induce any loose fibers to lie against the surface of the tubing, a heated circular die is positioned on the movement axis upstream of the first coating pot. There are no elements contacting the tubing between the heated circular die and the exit aperture of the last curing oven which would tend to deform the tubing from a circular cross section.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DETAILED DESCRIPTION

Figure 1:
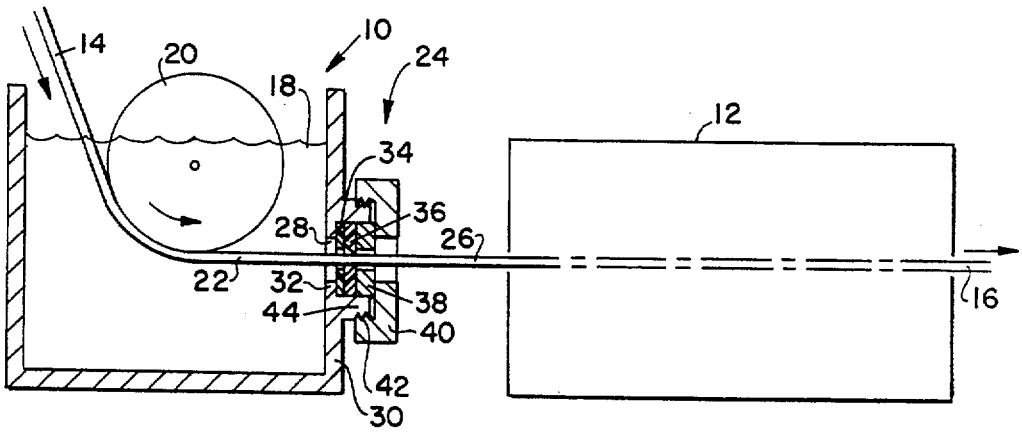
FIG. 1 depicts apparatus for impregnating woven yarn tubing with a latex sealant for waterproofing.

Referring first to FIG. 1, depicted in highly schematic fashion are a tank 10 and a drying oven 12 for impregnating woven yarn tubing 14 with a latex sealant to produce latex-impregnated woven yarn tubing 16.

Impregnating with latex sealant for waterproofing is highly desirable, even though the end product produced by the invention is plastic coated, because otherwise the interior of the plastic-coated tubing is susceptible to moisture absorption under environmental conditions, and subsequent rotting.

Contained within the tank 10 is a quantity of liquid latex sealant 18, which is water-based and relatively dilute for rapid penetration through the fibers of the untreated woven yarn tubing 14. A suitable material for the liquid latex sealant 18 is known as "black waterproofer" (although the end result is actually gray), available from Chemionics in Talmadge, Ohio. The untreated woven yarn tubing 14 enters the tank 10 from a supply source (not shown) generally at the upper left in the FIG. 1 orientation. A suitable wheel 20 within the tank 10 ensures that tubing 22 within the tank 10 is submerged, and is in alignment with an exit seal assembly, generally designated 24, to emerge at 26 as wet woven yarn tubing.

The seal assembly 24 is similar to assemblies described hereinbelow in greater detail with reference to FIG. 3, and surrounds an aperture 28 in a sidewall 30 of the tank 20. Very briefly, the seal assembly 24 includes an annular shoulder 32 within the aperture 28. The shoulder 32 supports a metal washer 34, a rubber die 36 and another metal washer 38, all compressed by an apertured endcap 40 having internal screw threads 42 engaging an externally threaded nipple 44 on the tank 10 sidewall 30.

The wet woven yarn tubing at 26 then enters the drying oven 12, which is a conventional heated air drying oven suitable for drying and curing the latex sealant. It will be appreciated that FIG. 1 is a highly schematic depiction, as various pulleys and driving wheels for conveying the woven yarn tubing in its various forms 14, 22, 26 and 16 through the impregnating process are omitted, as these are all conventional.

Figure 2:
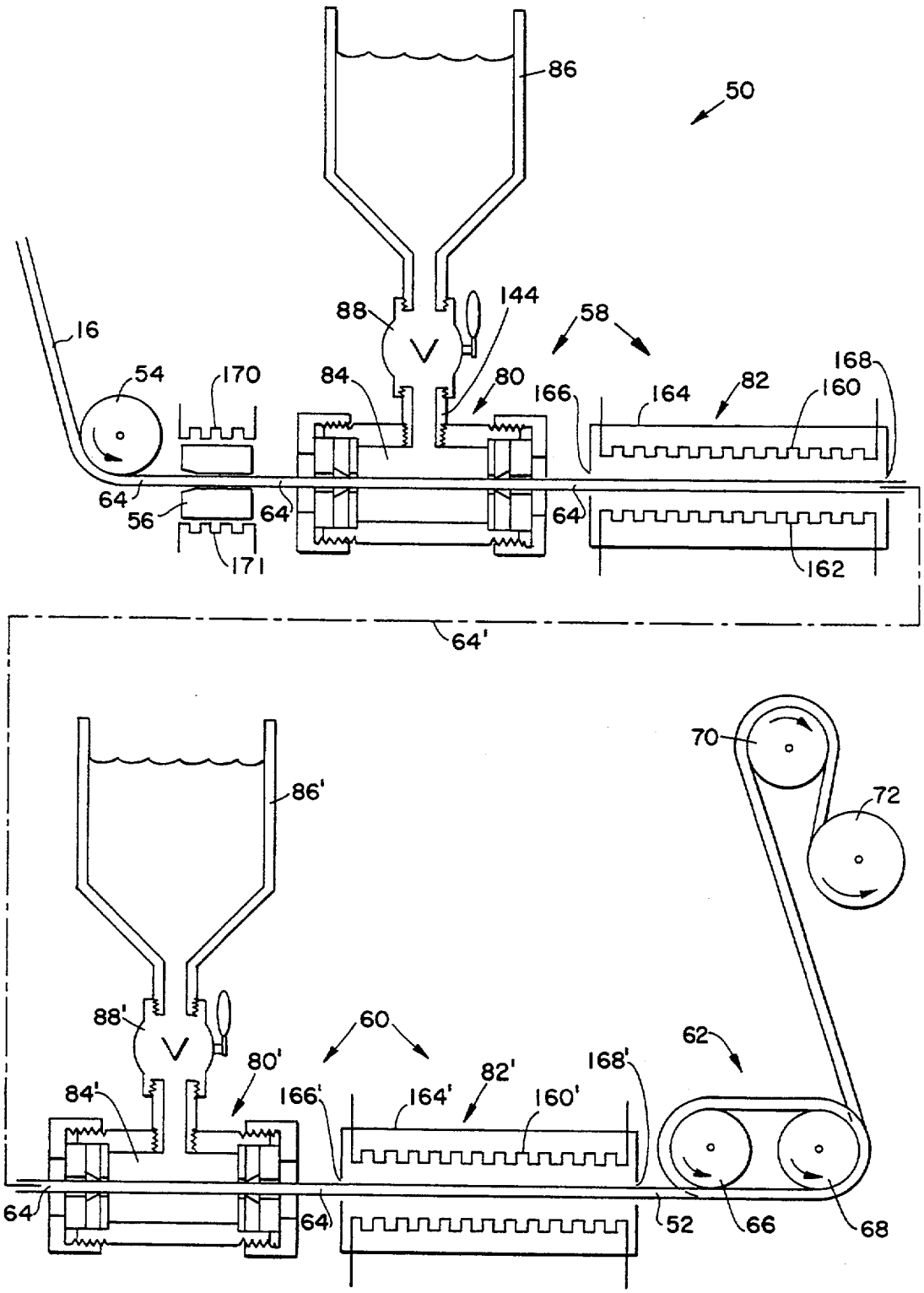
FIG. 2 depicts apparatus in accordance with the invention for applying a plastic coating to woven yarn tubing.

With reference now to FIG. 2, apparatus in accordance with the invention for applying a plastic coating to woven yarn tubing in a continuous process is generally designated 50. The apparatus 50 receives latex-impregnated woven yarn tubing 16, and delivers finished plastic-coated woven yarn tubing 52, at a relatively high rate of speed, such as 90 feet per minute. In overview, the apparatus 50 includes an entrance roller 54 for guiding the tubing 16 into the rest of the apparatus 50, a heated die 56, a first treating station generally designated 58, a second treating station, generally designated 60, and a take-up mechanism, generally designated 62.

The apparatus 50 defines a horizontal, substantially straight movement axis 64 along which the woven yarn tubing 16 moves through the entrance die 56 and the two treating stations 58 and 60. For convenience of illustration, in FIG. 2 the first treating station 58 is shown above the second treating station 60. However, in the actual apparatus, the two treating stations 58 and 60 are in alignment along the horizontal movement axis, as indicated by the line 64', which represents a straight connection.

Motive force for the woven yarn tubing 16 is provided by the take-up mechanism 62, which comprises a pair of motor-driven rolls 66 and 68 about which the tubing 52 is wrapped several times along the rolls 66 and 68, such that the tubing 52 is adequately friction-gripped. Plastic-coated tubing 52 from the take-up mechanism 62 passes over an overhead pulley 70, to be finally collected on a suitable conventional storage device, generally designated 72.

Considering the treating stations 58 and 60 of the apparatus 50 in greater detail, the first treating station 58 is representative, and includes a coating pot 80 on the movement axis 64 and an infrared curing oven 82, also on the movement axis 64, downstream of the coating pot 80. The interior of the coating pot 80 contains a liquid plastisol material 84, supplied from a reservoir 86 through a control valve 88, all suitably piped. A suitable plastisol material is Stock No. 3701848, available from Chemionics, in Talmadge, Ohio.

Figure 3:
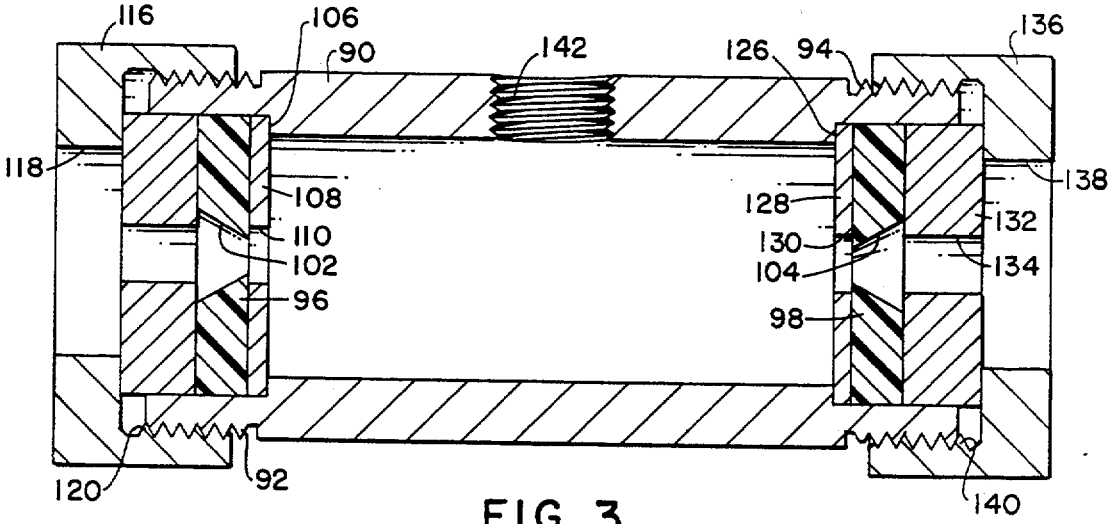
FIG. 3 is an enlarged cross-sectional view of one of the coating pots employed in the apparatus of FIG. 2.

With reference to the enlarged, cross-sectional view of FIG. 3, the coating pot 80 more particularly comprises a pipe-like cylindrical body 90 approximately eight inches in length and two inches in diameter, with exterior straight threads 92 and 94 at either end. Thus, to facilitate adjustment, the threads 92 and 94 are preferably not tapered in the manner of ordinary pipe threads.

The coating pot 80 has a resilient circular entrance die 96 and a resilient circular exit die 98, both suitably sized for the particular tubing diameter being processed, and positioned in alignment with the movement axis 64 such that woven yarn tubing passes through the entrance die 96 to the interior 100 of the coating pot 80, and then through the exit die 98. The dies 96 and 98 and the tubing cooperate to prevent flow of liquid plastisol material out of the coating pot 80, while allowing a layer of liquid plastisol material to remain on the tubing as the tubing passes through the exit die 98.

In the particular construction illustrated, the entrance and exit dies 96 and 98 comprise rubber, with respective tapered apertures 102 and 104. Since the apertures are tapered, each aperture opening is relatively smaller in diameter on one side (defining a bevel of less than 90° between the one side and the aperture), and is relatively larger in diameter on the other side (defining a bevel of greater than 90° between the other side and the aperture). The entrance die 96 is oriented "normally", with the relatively larger opening side of the aperture 102 facing upstream. However, to minimize the amount of plastisol material left on the tubing. The exit die 98 is oriented "backwards", that is, with the relatively smaller opening side of the aperture 102 facing upstream, and thus facing the entrance die 96.

In addition, the exit die is made of relatively stiff material. By way of example, the entrance die 96 may be made of gum rubber of 30 to 35 durometer, while the exit die 98 may be made of neoprene of 60 to 70 durometer.

Considering the structure for holding the dies 96 and 98, at the entrance end of the coating pot 80 there is a shoulder 106 formed in the sidewall of the body 90 and which supports an inner washer 108 having a central aperture 110 suitably sized for the particular tubing being processed, and against which one side of the entrance die 96 bears. The other side of the entrance die 96 is pressed against by an outer washer 112, likewise having an aperture 114 suitably sized for the particular size of tubing being processed, and a thickness which compensates for the thickness of the particular rubber entrance die 96 being employed. Finally, an endcap 116 having a relatively large universal aperture 118 bears against the outer washer 114, and has internal screw threads 120 which engage the external screw threads 92 of the body 90 for securing the assembly, and for adjustment purposes. Thus, tightening or loosening the endcap 116 controls the degree of compression of the rubber entrance die 96, thus providing a means of adjustment. This particular adjustment advantageously is employed to control the amount of resistance to the pulling force of the take-up mechanism 60, and thus to control tension on the tubing.

Associated with the exit die 98 is an essentially identical structure including a shoulder 126, an inner washer 128 having an aperture 130, an outer washer 132 having an aperture 134, and an endcap 136 having a universal aperture 138 and internal screw threads 140 which engage the external screw threads 94 of the body 90.

Tightening or loosening the endcap 136 controls the degree of compression of the rubber exit die 98. This particular adjustment is employed to control the thickness of the liquid plastisol coating layer.

To complete the coating pot 80, formed in an upper portion of the body 90 is an internally-threaded aperture 142 for receiving a threaded pipe nipple 144 (FIG. 2) which conveys liquid plastisol material from the tank 86 and the valve 88.

Referring again to FIG. 2, downstream of the coating pot 80, and as part of the first treatment station 58, is the infrared curing oven 82, which includes several infrared heating elements, represented by heating elements 160 and 162.

More particularly, the infrared curing oven 82 comprises a steel enclosure 164, preferably shiny and reflective on the inside, which has an entrance aperture 166 and an exit aperture 168 along the movement axis 64 and through which the tubing respectively enters and exits the curing oven 82. The apertures 166 and 168 are sufficiently large, for example two or three inches in diameter, such that the tubing makes no contact whatsoever. The curing oven 82 is approximately four feet in length, and, for example, includes a total of eight infrared heating elements, each approximately sixteen inches in length, and rated at 1600 watts. Suitable heating elements are Type No. DWG&E-93017, manufactured by Fostoria Industries.

The second treatment station 60 is essentially identical to the first treatment station 58, and so is not further described herein. Elements of the second treating station 60 corresponding to those of the first treatment station 58 are designated with primed reference numerals.

Briefly considering the heated entrance die 56, the purpose of the heated entrance die 56 is to improve uniformity of the final product by inducing loose fibers to lie against the surface of the tubing 16 prior to entering the first plastisol coating pot 80. The die 56 is electrically heated, as represented by heating elements 170 and 171, typically to a temperature of 300° F.

As noted hereinabove, one of the features of the invention is that there are no elements which contact the tubing between the coating pot 80 entrance die 96 and the take-up device 62 which would tend to deform the tubing from a circular cross-section while the plastisol is uncured. In the preferred embodiment, nothing contacts the tubing between the heated circular die 56 and the take-up mechanism 62 which would tend to form the tubing. Thus, preferably the only elements contacting the heated yarn tubing are the entrance and exit dies 96 and 98, and the heated die 56. At all other points the tubing in this continuous process is suspended under tension resulting from force produced by the take-up device 62 pulling against the various dies 56, 96 and 98. Tension control and thus sag control is primarily provided by adjustment of the coating pot 80 and 80' entrance endcaps 116, which control the compression of the resilient circular entrance dies 96.

Although the movement axis is characterized hereinabove as a straight, horizontal line, it will be appreciated that the tubing sags somewhat under the force of gravity, but nevertheless maintains substantially a straight line. The entrance apertures 166 and 166' and the exit apertures 168 and 168' of the curing ovens 82 and 82' are sufficiently large in diameter to accommodate such sag.

Although not illustrated, in some cases it is desirable to provide cooling fans for blowing air over the tubing as it exits each of the curing ovens 82 and 82'. Thus, the tubing is cooled somewhat after it exits the first curing oven 82 prior to entering the second coating pot 80', and after it exits the second curing oven 82' prior to the take-up device 62.

Figure 4:
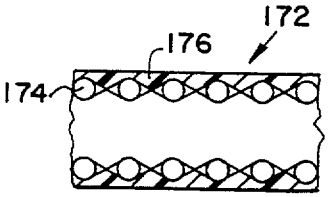
FIG. 4 PRIOR ART
FIG. 4 is a longitudinal cross-sectional representation of plastic-coated yarn tubing or conduit produced by a prior art process.

FIG. 4 is a longitudinal cross-sectional representation of plastic-coated tubing 172 produced by a prior art process. The tubing 172 of FIG. 4 comprises an inner core 174 of latex-impregnated woven yarn, with an outer plastic coating layer 176. The plastic layer 176 is relatively thick, tending to fill in the valleys of the woven yarn core 174, and consequently comprising a relatively large quantity of material.

Figure 5:
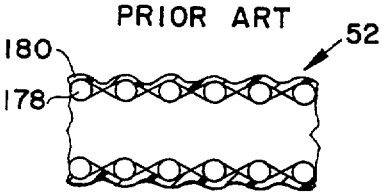
FIG. 5 is a longitudinal cross-sectional representation of plastic-coated yarn tubing or conduit produced in accordance with the invention.
Figure 6:
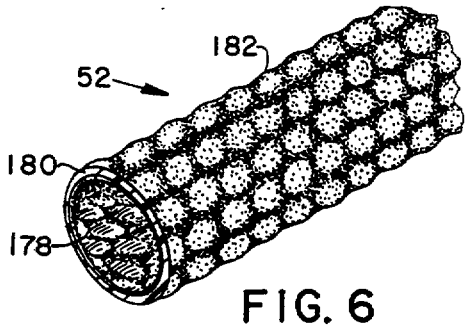
FIG. 6 is a three-dimensional representation partly in section, of the plastic-coated yarn tubing or conduit produced in accordance with the invention.

FIG. 5 is a longitudinal cross-sectional representation of the finished plastic-coated tubing 52 produced by the invention, in contrast to the tubing 172 of FIG. 4, and FIG. 6 is a three-dimensional view, partly in cross-section, of the finished plastic-coated tubing 52 produced by the invention. FIG. 4 is a representation only, as the two layers shown tend to merge into each other, and the thicknesses of the layers, particularly the plastic coating layer, are greatly exaggerated for purposes of illustration.

In particular, the tubing 52 comprises an inner core 178 of latex-impregnated woven yarn, with an outer plastic coating layer 180. Although not so illustrated, it will be appreciated that the outer plastic coating layer 180, having been initially applied in uncured liquid form, partially penetrates at least the outer portions of the inner core 178 and in localized regions may actually penetrate all the way through. Also, in the final product 52, the plastic coating layer 180 appears as a single layer, even though it is formed as two successive sublayers. Being of the same material, there is no discernible boundary between the two sublayers. The coating 172 is approximately 0.002 inch in thickness, and has an outer surface 182 which follows the woven, contoured surface of the inner core 170. The wall of the inner core 170 is approximately 0.040 to 0.100 inch in thickness, depending on the tubing diameter.

As noted hereinabove, the invention owes its performance in large measure to the application of a coating of plastisol material that follows the contours of the woven yarn tubing, which minimizes the use of plastisol material and facilitates rapid curing. Other important characteristics are the use of the infrared curing ovens 82 and 82', as well as the two-stage process whereby the plastisol coating 172 is applied in two relatively thin layers. Thus, the process proceeds at a relatively high rate of speed, in the order of 90 feet per minute, with minimal use of plastisol resulting in a cost-effective process which produces a superior product.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A method for applying a plastic coating to woven yarn tubing, said method comprising the steps of:

providing a length of woven yarn tubing having a contoured surface; and continuously pulling the tubing through a coating pot containing a liquid plastisol material and having a resilient circular exit die through which the tubing exits the coating pot to form a layer of liquid plastisol on the woven yarn tubing sufficiently thin so as to follow the surface contours, and then through an infrared curing oven including an infrared heating element which heats the plastisol-coated tubing sufficiently to cure the plastisol layer, without contacting the tubing while coated with uncured plastisol with any element which would tend to deform the tubing from a circular cross-section.

2. A method in accordance with claim 1, which comprises pulling the length of tubing horizontally in a substantially straight line through the coating pot and through the infrared curing oven.

3. A method in accordance with claim 1, wherein said step of continuously pulling the tubing through a coating pot and then through an infrared curing oven further comprises pulling the tubing through a heated circular die immediately prior to the coating pot to promote conformity of the tubing to a circular cross section and to induce any loose fibers to lie against the surface of the tubing.

4. A method in accordance with claim 3, which comprises pulling the length of tubing horizontally in a substantially straight line through the heated circular die, the coating pot and the infrared curing oven.

5. A method in accordance with claim 3, wherein said step of providing a length of woven yarn tubing comprises providing tubing which has been impregnated with a latex sealant for waterproofing.

6. A method in accordance with claim 1, wherein said step of providing a length of woven yarn tubing comprises providing tubing which has been impregnated with a latex sealant for waterproofing.

7. A method in accordance with claim 1, wherein said step of continuously pulling the tubing through a coating pot and then through an infrared curing oven further comprises, after the infrared curing oven, then pulling the tubing through a second coating pot containing liquid plastisol material to form a second layer of liquid plastisol on the woven yarn tubing sufficiently thin so as to follow the surface contours, and then through a second infrared curing oven to cure the second plastisol layer.

8. A method in accordance with claim 7, which comprises pulling the length of tubing horizontally in a substantially straight line through the coating pot, through the infrared curing oven, through the second coating pot and through the second infrared curing oven.

9. A method in accordance with claim 7, wherein said step of continuously pulling the tubing through a coating pot, then through an infrared curing oven, then through a second coating pot and then through a second infrared curing oven further comprises pulling the tubing through a heated circular die immediately prior to the initial coating pot to provide conformity of the tubing to a circular cross section and to induce any loose fibers to lie against the surface of the tubing.

10. A method in accordance with claim 9, which comprises pulling the length of tubing horizontally in a substantially straight line through the heated circular die, the initial coating pot, the initial infrared curing oven, the second coating pot and the second infrared curing oven.

11. Apparatus for applying a plastic coating to woven yarn tubing having a contoured surface continuously moving along a movement axis, said apparatus comprising:

a coating pot containing a liquid plastisol material and located on the movement axis, said coating pot including a resilient circular entrance die and a resilient circular exit die positioned in alignment with the movement axis such that the woven yarn tubing passes through said entrance die to the interior of said coating pot and then through said exit die, said dies and the tubing cooperating to prevent flow of the liquid plastisol material out of said coating pot while allowing a layer of liquid plastisol material sufficiently thin so as to follow the surface contours to remain on the tubing as the tubing passes through said exit die;

an infrared curing oven on the movement axis downstream of said coating pot, said curing oven having an entrance aperture in alignment with the movement axis through which plastisol-coated tubing enters said curing oven and an exit aperture in alignment with the movement axis through which the tubing exits said curing oven, said curing oven including at least one infrared heating element operable to heat the plastisol-coated tubing sufficiently to cure the plastisol layer; and a take-up mechanism on the movement axis downstream of said infrared curing oven for pulling the tubing through said coating pot and through said infrared curing oven;

there being no elements contacting the tubing between said coating pot entrance die and said curing oven exit aperture which would tend to deform the tubing from a circular cross-section while the plastisol is uncured.

12. Apparatus in accordance with claim 11, wherein:

said exit die has a tapered aperture such that the aperture opening is relatively smaller in diameter on one side of said exit die, and the aperture opening is relatively larger in diameter on the other side of said exit die; and wherein said exit die is oriented such that said one side of said exit die with the relatively smaller aperture opening faces said entrance die.

13. Apparatus in accordance with claim 11, which further comprises a heated circular die on the movement axis upstream of said coating pot for promoting conformity of the tubing to a circular cross section and for inducing any loose fibers to lie against the surface of the tubing, there being no elements contacting the tubing between said heated circular die and said curing oven exit aperture which would tend to deform the tubing from a circular cross-section.

14. Apparatus in accordance with claim 13, wherein the movement axis is horizontal.

15. Apparatus in accordance with claim 11, wherein the movement axis is horizontal.

16. Apparatus in accordance with claim 11, which is for applying a plastic coating to woven yarn tubing which has been impregnated with a latex sealant for waterproofing.

17. Apparatus for applying a plastic coating to woven yarn tubing continuously moving along a movement axis, said apparatus comprising:

a first coating pot containing a liquid plastisol material and located on the movement axis, said first coating pot including a first coating pot resilient circular entrance die and a first coating pot resilient circular exit die positioned in alignment with the movement axis such that the woven yarn tubing passes through said first coating pot entrance die to the interior of said first coating pot and then through said first coating pot exit die, said first coating pot dies and the tubing cooperating to prevent flow of the liquid plastisol material out of said first coating pot while allowing a layer of liquid plastisol material sufficiently thin so as to follow the surface contours to remain on the tubing as the tubing passes through said first coating pot exit die;

a first infrared curing oven on the movement axis downstream of said first coating pot, said first curing oven having a first curing oven entrance aperture in alignment with the movement axis through which plastisol-coated tubing enters said first curing oven and a first curing oven exit aperture in alignment with the movement axis through which the tubing exits said first curing oven, said first curing oven including at least one first curing oven infrared heating element operable to heat the plastisol-coated tubing sufficiently to cure the plastisol layer;

a second coating pot containing liquid plastisol material and located on the movement axis downstream of said first infrared curing oven, said second coating pot including a second coating pot resilient circular entrance die and a second coating pot resilient circular exit die positioned in alignment with the movement axis such that the woven yarn tubing passes through said second coating pot entrance die to the interior of said second coating pot and then through said second coating pot exit die, said second coating pot dies and the tubing cooperating to prevent flow of the liquid plastisol material out of said second coating pot while allowing a further layer of liquid plastisol material sufficiently thin so as to follow the surface contours to remain on the tubing as the tubing passes through said second coating pot exit die;

a second infrared curing oven on the movement axis downstream of said second coating pot, said second curing oven having a second curing oven entrance aperture in alignment with the movement axis through which plastisol-coated tubing enters said second curing oven and a second curing oven exit aperture in alignment with the movement axis through which the tubing exits said second curing oven, said second curing oven including at least one second curing oven infrared heating element operable to heat the plastisol-coated tubing sufficiently to cure the further plastisol layer; and a take-up mechanism on the movement axis downstream of said second infrared curing oven for pulling the tubing through said first coating pot, through said first infrared curing oven, through said second coating pot and through said second infrared curing oven;

there being no elements contacting the tubing between said first coating pot entrance die and said second curing oven exit aperture which would tend to deform the tubing from a circular cross-section while the plastisol is uncured.

18. Apparatus in accordance with claim 17, wherein:

each of said exit dies has a tapered aperture such that the aperture opening is relatively smaller in diameter on one side of the exit die, and the aperture opening is relatively larger in diameter on the other side of the exit die; and wherein said exit dies are each oriented such that the one side of the exit die with the smaller aperture opening faces the entrance die of the particular coating pot including the exit die.

19. Apparatus in accordance with claim 17, which further comprises a heated circular die on the movement axis upstream of said first coating pot for promoting conformity of the tubing to a circular cross section and for inducing any loose fibers to lie against the surface of the tubing, there being no elements contacting the tubing between said heated circular die and said second curing oven exit aperture which would tend to deform the tubing from a circular cross section.

20. Apparatus in accordance with claim 19, wherein the movement axis is horizontal.

21. Apparatus in accordance with claim 17, wherein the movement axis is horizontal.

22. Apparatus in accordance with claim 17, which is for applying a plastic coating to woven yarn tubing which has been impregnated with a latex sealant for waterproofing.

* * * * *